US005787625A

United States Patent [19]

Yesbick

[11] Patent Number: 5,787,625

[45] Date of Patent: Aug. 4, 1998

[54] AIR-CHAMBERED, WEATHERPROOF PICTURE FRAME

[76] Inventor: Jonathan D. Yesbick, 2450 N. Powerline Rd., Pompano Beach, Fla. 33069

[21] Appl. No.: 818,494

[22] Filed: Mar. 14, 1997

[51] Int. Cl.[6] ..... G09F 1/12

[52] U.S. Cl. ..... 40/718; 40/124.5; 40/712; 40/765

[58] Field of Search ..... 40/124.5, 712, 40/718, 760, 765, 770, 779

[56] References Cited

U.S. PATENT DOCUMENTS

| | | | |
|---|---|---|---|
| 196,919 | 11/1877 | McClain | 40/124.5 |
| 298,089 | 5/1884 | Holloman et al. | 40/124.5 |
| 695,774 | 3/1902 | White | 40/124.5 |
| 979,764 | 12/1910 | Humble, Jr. | 40/124.5 X |
| 1,269,828 | 6/1918 | Lockard | 40/779 |
| 1,966,922 | 7/1934 | Coleman | 40/124.5 |
| 2,070,940 | 2/1937 | Duchan | 40/124.5 X |
| 3,045,374 | 7/1962 | Lucken et al. | 40/124.5 |
| 3,161,975 | 12/1964 | McMillan | 40/718 |
| 4,790,088 | 12/1988 | Morvant | 40/124.5 |
| 4,848,014 | 7/1989 | Yesbick | 40/124.5 |
| 5,125,175 | 6/1992 | Huff, Jr. | 40/718 |

*Primary Examiner*—Brian K. Green
*Assistant Examiner*—Andrea Chop
*Attorney, Agent, or Firm*—Malin, Haley, DiMaggio & Crosby, P.A.

[57] ABSTRACT

An air-chambered frame for sealing a photograph or any document therein to protect against any type of moisture or environmental element. The frame comprises an integrally formed frame plate having a finished outer surface and a rear surface defining a plurality of recessions and a transparent lens section centrally located therein, a backing plate substantially the same outer dimensions of the frame plate, an adhesive gasket for joining the backing plate and frame plate and for sealing the contents therein from any moisture and an opaque cover plate which is removably attached to the frame plate for concealing the contents of the frame from view or light.

20 Claims, 4 Drawing Sheets

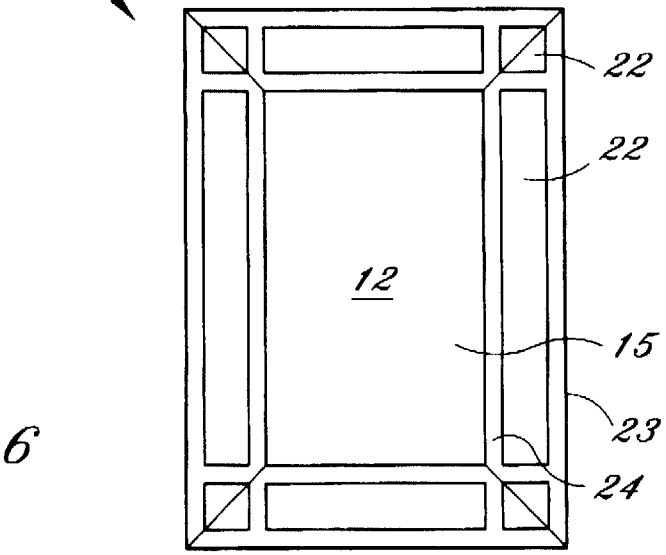
Fig. 5
Fig. 6
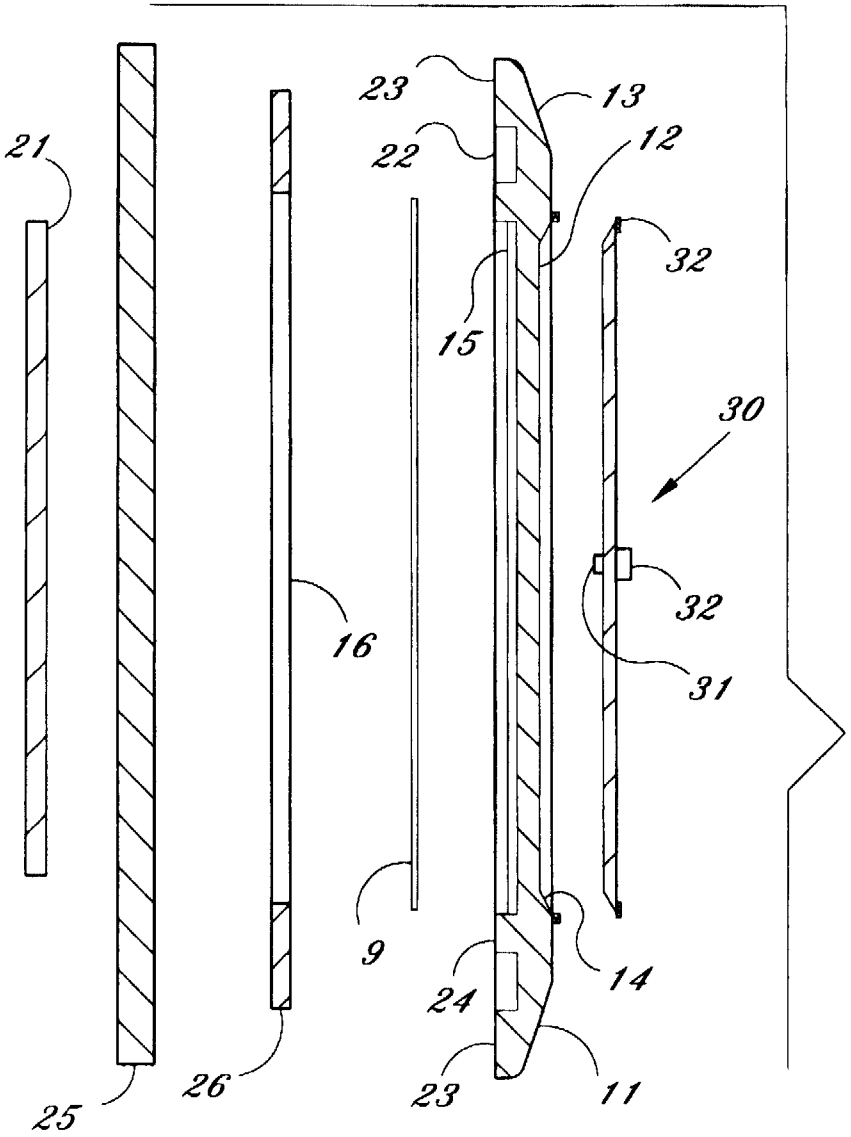

AIR-CHAMBERED, WEATHERPROOF PICTURE FRAME

BACKGROUND OF THE INVENTION

1. Field of the Invention

This invention relates generally to a weatherproof picture frame assembly, and more particularly to an integrally formed picture frame and cover plate assembly for sealing a photograph in a waterproof and sunproof enclosure so that the assembly may be permanently placed at a gravesite. The instant invention is also adapted for use in securely sealing other important documents, such as marine licenses and registrations, diplomas, awards, etc., in a weatherproof enclosure.

2. Description of the Prior Art

The desire to memorialize deceased loved ones is well recognized. Gravestones conventionally contain some thoughtful sentiment etched on the surface to identify and commemorate one's memorial. However, etching personalized inscriptions on monuments has been cost and space prohibitive, as well as impractical. In addition, standard monuments do not facilitate the permanent placement or display of a loved one's photograph. Conventional frames do not provide this opportunity either, as they are incapable of withstanding exposure to the elements, such as rain, ultraviolet (UV) sunlight, snow, ice, and sleet. Furthermore, frames are typically made with glass panes and are therefore fragile.

The initial need for a durable, weatherproof frame was addressed by the inventor herein in U.S. Pat. No. 4,848,014, the disclosure of which is incorporated herein by reference in its entirety. The '014 patent teaches an air-chambered picture frame comprising an integral frame assembly molded from a transparent polyethylene. The air-chambered picture frame includes a central recess for receiving a first backing plate and a pair of sealing ribs for cooperating with a second backing plate to form a sealed enclosure that prevents the entry of rain, moisture, dirt, etc. The air-chambered picture frame is also adapted for receiving a protective cover. The cover protects the lens and photo from UV ray sun damage and provides an element of privacy. A known protective cover comprises a plurality of posts which project from the back surface of the cover plate and securely mate with corresponding keyholes defined in the frame, as shown in FIG. 1. The broken posts and dirt have been known to lodge in the keyhole, rendering the cover useless and unsecured, requiring the replacement of the complete frame.

Another protective cover employed is permanently attached to the frame and cannot be replaced without replacing the entire frame. The protective cover comprises a door which is permanently hinged to the cover. The problem with this design is that when the door is not completely shut, it can be drawn up into a mower or tractor and destroyed. This not only leaves the photograph exposed, but ruins the frame and cover as well, since the door is permanently attached to the cover. Even if the cover and frame survive the damage caused to the door, the entire frame still must be replaced. Consequently, there exists a need for an improved air-chambered picture frame that includes a protective cover that may be removably attached to the frame for replacement, and which may be conveniently opened for viewing the photograph. A picture frame having a simplified structure and cover which can be decorated and personalized would also be well received.

Although a weatherproof frame has been provided, there still exists a need for an improved frame that addresses the foregoing. The instant invention solves the above-noted by providing an improved, durable, weatherproof air chamber picture frame that includes a removably attached cover in a simplified design.

SUMMARY OF THE INVENTION

In view of the above-noted needs, it is an object of the instant invention to provide an economical frame assembly that can readily withstand exposure to the environmental elements, yet provide selective viewing of its contents.

It is another object of the invention to provide a durable, weatherproof picture frame that can be permanently attached to a gravesite monument or urn and withstand exposure to the elements.

It is an additional object of the instant invention to provide a durable, weatherproof frame assembly that can be used to preserve important documents in addition to photographs by concealing and protecting them from the elements. For instant, such an assembly can be used to sealingly secure registration papers and licenses used in the marine industry.

It is a further object of the instant invention to provide a durable, weatherproof frame assembly that protects its contents from UV sunlight-induced damage.

It is yet another object of the instant invention to provide a durable, weatherproof frame assembly having a removably attached cover plate assembly that selectively conceals the frame's contents from light, and which can be replaced if damaged without having to replace the entire frame assembly.

It is still another object of the instant invention to provide a durable, weatherproof frame assembly that may be personalized with meaningful sentiments.

It is still an additional object of the instant invention to provide a durable, weatherproof frame assembly having a cover with a breakaway hinge that gives and breaks free from the frame assembly under a predetermined force.

In view of these and other objects, the instant invention comprises a frame assembly that is capable of withstanding a wide range of temperatures, both hot and cold, and substantially all environmental elements, such as rain, snow, humidity, UV sun rays, dirt, etc. The frame assembly of the instant invention is completely waterproof, such that it effectively and securely conceals, seals, and encloses a preselected photograph or other important document. In addition, the frame assembly of the instant invention selectively conceals its contents from view with a cover plate or door, which is removably attached to the frame assembly, preferably with a breakaway hinge or slidable door.

The frame assembly preferably comprises a main frame having a transparent viewing window for revealing the frame's contents and a backplate for securing the photograph or other document in the frame. The frame may include a centrally located, shallow recess for receiving the picture. To seal the photograph in the frame assembly, a double-sided adhesive gasket is affixed to the interior surface of the backplate and adhered to the rear face of the frame's border. When assembled, the backplate and rear face of the frame sandwich the photograph therein. The rear face of the frame's border is provided with a plurality of shallow recesses which are overlaid by the gasket to form an air-chambered protective border around the photograph. The shallow recesses provide a pair of sealing ribs on each of the four sides of the frame. Each pair of sealing ribs cooperates with the backing plate and gasket to form a sealing surface that prevents the entry of rain, moisture, dirt, etc., which would have a deleterious effect on the picture or document within the frame. The gasket may provide a border around the picture or cover the entire inner surface of the backplate while providing an adhesive surface for placing the photograph. A second adhesive means is affixed to the exterior surface of the backplate and is exposed by peeling off a covering tape so that the frame assembly may be attached to a monument, stone, urn, or other selected surface. Since the frame assembly is made of a lightweight plastic and the backing plate presents a smooth surface, it is readily attached by applying pressure across the front of the frame with one's hands.

In accordance with the preferred object of the instant invention, the frame assembly incorporates a cover plate that is removably attachable to the frame assembly so that the cover may be replaced without having to replace the entire frame. The cover plate and front surface frame border provide a decorative exterior display that may be personalized with etching. This exterior front surface may comprise a bronze, greystone, or other suitable finish. The cover plate is preferably attached to the frame assembly by a breakaway hinge. The cover plate may also be slidably attached to the frame assembly in an alternative embodiment, whereby the frame assembly defines opposing grooves and at least one open end for slidably receiving the cover plate. The advantage of the instant invention is that the cover plate is removably attached to the frame assembly so that it can be replaced in the event of damage without necessitating the replacement of the entire frame assembly. This not only reduces cost to the consumer, but provides convenience as well. The cover plate is further designed for personalized etching on both the exterior and inner surfaces so that meaningful sentiments may be displayed along with the photograph. Since the cover plate is detachable, it may be replaced with other cover plates having different sentiments etched on the inner or outer surfaces. It is important to note that the instant invention is primarily described with respect to securely enclosing photographs, but it may also accommodate other types of important documents that an owner wishes to display and preserve. These documents may include papers used in the marine industry, diplomas, awards, licenses, and any other selected document.

In accordance with these and other objects which will become apparent hereinafter, the instant invention will now be described with particular reference to the accompanying drawings.

BRIEF DESCRIPTION OF THE DRAWINGS

FIG. 5 is a rear plan view of the frame plate of the instant invention, illustrating the sealing recesses and ribs.

FIG. 6 is an exploded cross sectional view of the instant invention taken along section line 6—6 of FIG. 2.

DESCRIPTION OF THE PREFERRED EMBODIMENTS

Figure 2:
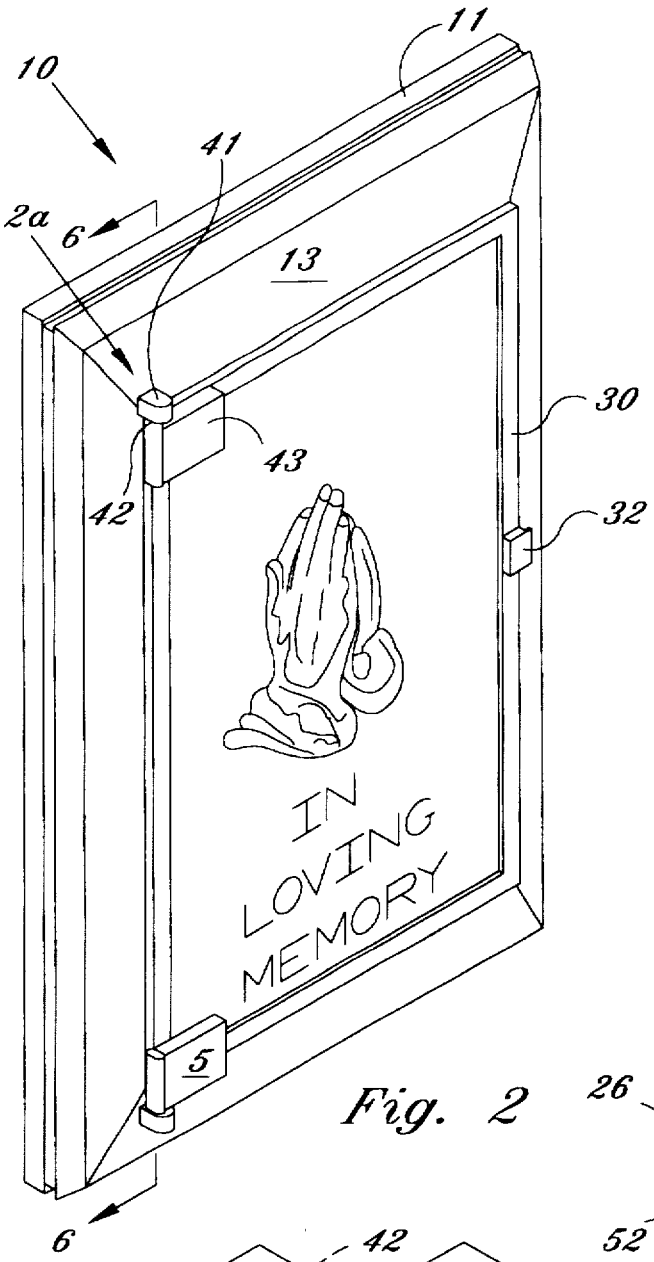
FIG. 2 is a front perspective view of the frame assembly of the instant invention employing the cover plate with a breakaway hinge.
Figure 2A:
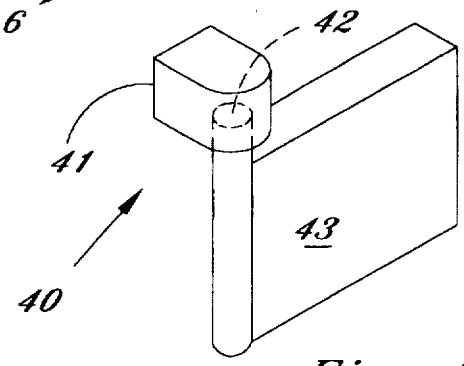
FIG. 2*a* is an enlarged detailed view of the breakaway hinge.

With reference to the drawings, FIGS. 2–9 depict the preferred embodiments of the frame assembly of the instant invention, which is generally characterized by the reference numeral 10. The frame assembly 10 of the instant invention generally comprises an integrally molded frame plate 11, a corresponding backing plate 25, an adhesive gasket 26 joining the frame plate 11 and backing plate 25, a transparent viewing area or lens 12 for displaying the photograph sandwiched and sealed therein, and a cover plate 30 removably attached to the frame plate 11 for selectively viewing and concealing a photograph 9 disposed therein. The cover plate 30 also performs the crucial function of protecting the photograph 9 from damaging UV rays. It is well known that UV rays can quickly fade a photograph beyond reasonable recognition.

Figure 1:
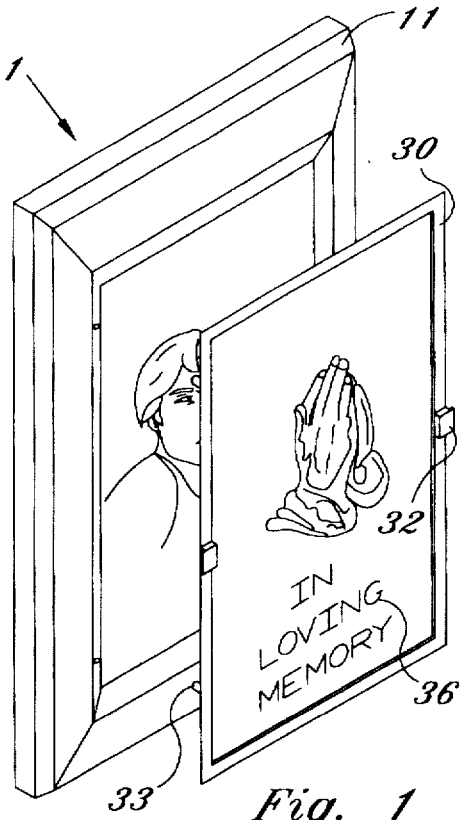
Fig. 1 (Prior Art)
FIG. 1 is a front perspective view of a frame assembly having a cover enclosure with the post and keyhole system.

With reference to FIG. 1, the inventor previously designed a frame assembly 1 comprising a cover plate 30 removably attached to the enclosure 1 with a plurality of posts 33 projecting from the back of the plate 30 and corresponding keyholes formed in the face of the frame. The cover plate 30 provides a UV stabilizing door which protects the photograph 9 from UV light-induced damage while affording privacy. The posts 33 project from the cover 30 and mate with the corresponding keyholes. These posts have been known to break inside the keyholes. Dirt and debris has also been known to clog the keyholes when the cover is not properly installed. In either event, the frame 1 has to be completely replaced when this occurs. Consequently, the instant invention comprises a cover plate 30 which is removably attached to the frame plate 11 with a releasing securing means that does not have the noted problem. The releasing securing means may comprise a breakaway hinge assembly 40, or a track and rail system 50, as described herein.

Figure 3:
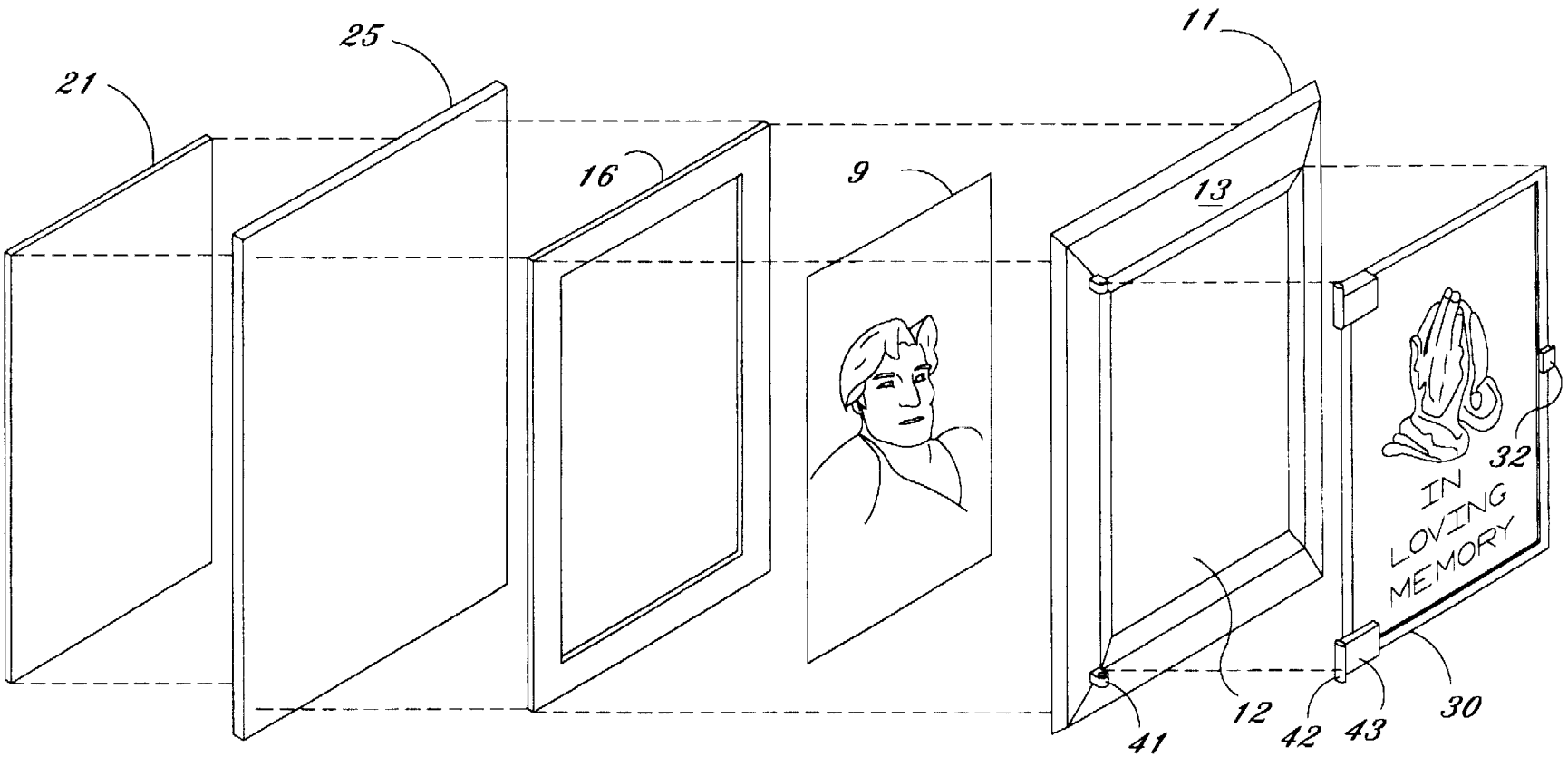
FIG. 3 is an exploded view of the frame assembly shown in FIG. 2, illustrating the orientation and connection of each piece comprising the invention.
Figure 7:
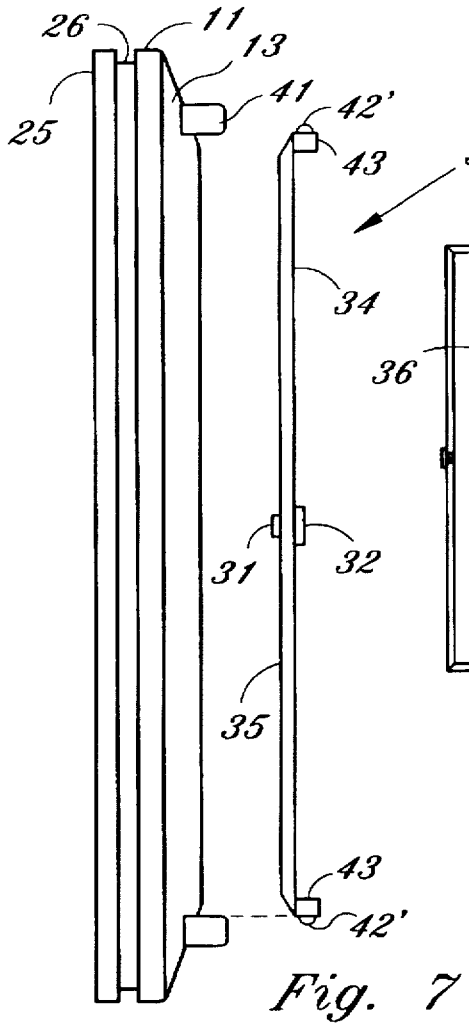
FIG. 7 is a side elevational view of the frame assembly of the instant invention showing the cover removed.
Figure 8:
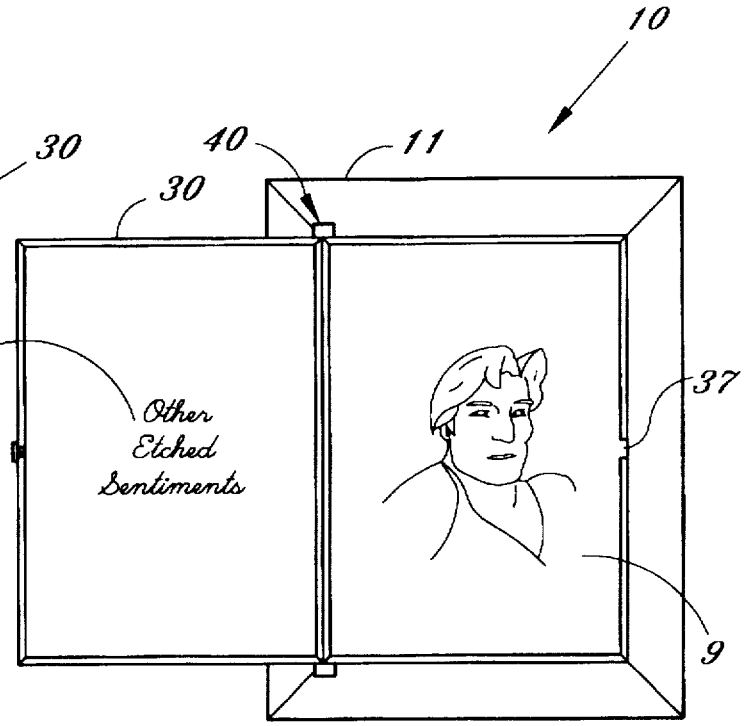
FIG. 8 is a front elevational view of the instant invention illustrating the cover, with a breakaway hinge, opened.

The frame assembly 10 preferably comprises an integrally molded frame 11 defining a transparent viewing area 12. The transparent viewing area 12 is bordered by an inwardly beveled surface 14 which mates with or cooperates with a peripheral beveled edge defined by the cover plate 30, as seen in FIGS. 3 and 6. As indicated in the drawings, the frame plate 11 has a finished surface 13 for a decorative look and to prevent filtration of light into the assembly 10. The frame plate surface 13 may have a greystone or bronze finish or any other suitable finish, so long as it is impervious to light. The finished surface 13 thus serves to make the frame plate 11 opaque and decorative, and also places emphasis on the viewing area 12 which is clear and translucent. The entire frame assembly 10 may be molded of a polyethylene, polycarbonate, polyvinyl chloride, or any other durable, plastic-like material. Although the frame assembly 10 may be molded, other manufacturing processes may be employed. For example, injection molding, hot stamping, or vacuum forming could be utilized. The above-noted materials are preferred for the frame assembly 10 to insure against cracking, discoloring, joint separation due to warping, or blistering due to exposure to the environmental elements, whether it is hot or cold exposure, rain, sleet, snow, dirt, etc. The frame assembly 10 of the instant invention is also designed to have walls of substantial thickness to resist breakage.

Figure 4:
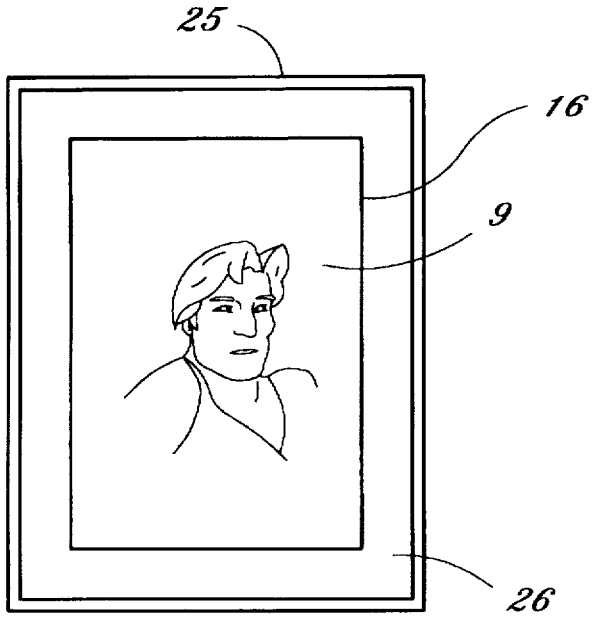
FIG. 4 is a front plan view of the backplate and gasket of the instant invention, showing a photograph oriented therein.

With reference to FIGS. 2–4, a photograph 9 is sandwiched and sealed within the frame assembly 10. The adhesive gasket 26 overlays and adheres to the backing plate 25 and is joined to the frame plate 11 to form an air-chambered air tight seal that protects the frame's contents. The gasket 26 comprises a pliable rubber-like material having adhering properties on both its front and rear surfaces so that it securely joins the backing plate 25 to the frame plate 11, forming a sealed fit and securing the photograph 9 therein. The photograph 9 is viewable through the lens viewing area 12 which remains translucent and has a beveled border 14. As shown, the gasket 26 not only joins the backing plate 25 and frame plate 11, but seals the photograph 9 therein, protecting it from moisture and all other elements. It has been determined that the frame assembly 10 may be submerged in water and maintain an airtight seal. The frame plate 11 may overlap the back plate 25 as shown in FIG. 2 or may align with it as shown in the other Figures.

An attaching means 21 may be affixed to the rear surface of backing plate 25 for attaching the frame assembly 10 to a monument. The attaching means may comprise a two-sided adhesive pad 21. On the inner surface, a peel-off tape is removable for affixing the adhesive pad to the backing plate 25. On the opposing surface, another peel-off tape may be removed for exposing the adhesive and affixing to the desired surface. Likewise, the gasket 26 may have peel-off tape on both surfaces for exposing the adhesive.

Referring to FIG. 5, there is shown a rear view of frame plate 11. The rear surface of the frame plate 11 includes a plurality of recesses 22 and a pair of sealing ribs 23, 24, all of which cooperate with the backing plate 25 to sandwich a photograph or other document in an air-tight chamber. The backing plate 25 preferably conforms to the outer dimensions of the frame plate 11 and is attached to the backing plate 25 with an adhesive such as that provided by the gasket 26. The gasket 26 is sandwiched between the rear surface of the frame plate 11 and the front surface of the backing plate 25 and securely joins the two. With reference to FIGS. 5 and 6, the back or rear side of frame plate 11 is provided with a central recess 15 which is adapted to receive the photograph 9. The recess 15 is very shallow, but is designed to accommodate a conventional photograph. Since a recess 15 is provided on the rear side of the frame plate 11, the gasket 26 may cover the entire surface of backing plate 25. Preferably, however, the gasket 26 provides a surrounding border for the photograph 9, as shown in FIGS. 3 and 4. In either event, the photograph is completely enclosed within the recess 15, and a seal is formed around the peripheral edges thereof to prevent moisture, water, or the like from entering. The recess 15 is in direct alignment with the lens viewing area 12. Viewing access to the lens viewing area 12 is provided by the cover plate 30.

The instant invention represents an improvement over the prior art, as it includes a unique cover plate 30 design which conceals the contents of the frame assembly from sunlight. In fact, the cover plate 30 cooperates with the finished surface 13 in providing a light impervious surface. The uniqueness of the cover plate design is found in the variety of attaching means used for securing the cover plate 30 to the frame plate 11. The attaching means comprises a couple of embodiments, all of which are detachable from frame plate 11 under a predetermined amount of force. Regardless of the attaching means employed, a sealed and substantially airtight fit is preferably effectuated between the peripheral edges of the cover plate 30 and the border of the viewing area 12. The viewing area 12 is defined by a beveled viewing area border 14 which complements the beveled peripheral edges of the cover plate 30. Thus, when the cover plate 30 is inserted over the viewing area 12, a mated fit is achieved between the beveled viewing area border 14 and the cover plate's peripheral edges, as shown in FIGS. 2, 3, 6, and 8. This beveled design is provided for each embodiment. To open the cover plate 30 from the frame plate 11, a plurality of flanges 32 are provided for gripping the cover plate 30 for inserting and removing the cover plate.

In one embodiment, the preferred attaching means comprises a breakaway hinge assembly 40, as shown in FIGS. 2, 3, and 6–8. The breakaway hinge assembly 40 comprises a pair of hinge pockets 41, corresponding hinge posts 42, and hinge post platforms 43. The hinge pockets 41 comprise shallow detents formed on the interior surface of the pockets 41. A hinge post 42 is provided on both the upper and lower inside edges of the cover plate 30 for cooperating with the hinge pocket detents 41. The hinge post 42 projects slightly outward from the respective hinge post platforms 43 so that there is an interference fit achieved between the pockets 41 and the post 42. Although a secure fit is achieved, the hinge post 42 may be forced free from the hinge pockets 41 under sufficient force. This allows the cover plate 30 to break free from the frame plate 11 before causing damage thereto and to be replaced if it is damaged. To replace the cover plate 30, a new plate 30 is aligned with the hinge pockets 41 and snapped into place. The cover plate 30 is secured shut with a latch system comprising a latch 31 which latches into a notch 37 defined by the frame plate 11 in the beveled surface 14. A gripping flange 32 protrudes from the plate 30 for gripping in opening and closing the plate 30.

Figure 9:
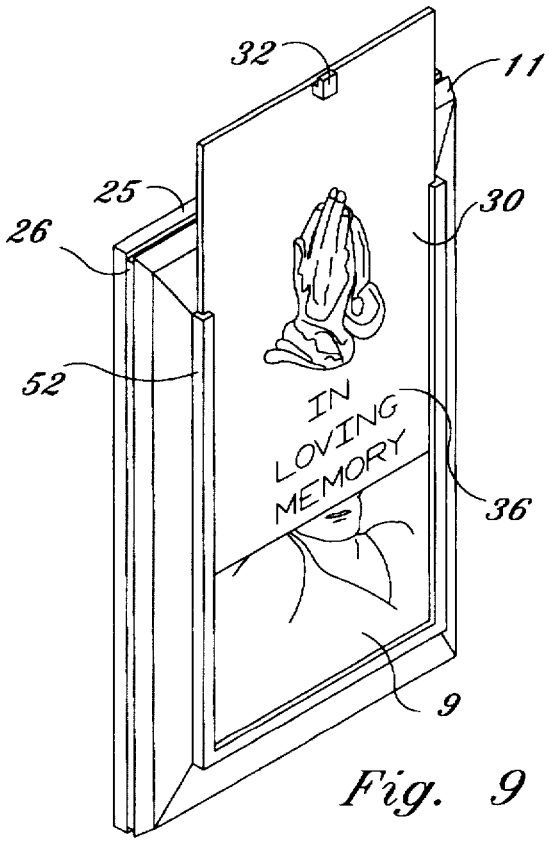
FIG. 9 is a front perspective view of the frame assembly of the instant invention, illustrating the embodiment comprising a slidable cover plate.

In another embodiment, the attaching means comprises a track and rail system, as shown in FIG. 9. In this embodiment, the side edges of the viewing area 12 form elongated tracks 52 for receiving the outer edges of the cover plate 30. The lower edges of the tracks 52 may be closed off for securing the cover plate 30 therein. A flange 32 may be formed along the top edge of the cover plate 30 for inserting and removing the cover plate 30.

In all embodiments of the instant invention, the front or outer surface 34 of the cover plate 30 is designed for accommodating the etching of personal sentiments 36. Likewise, the interior surface 35 may also be etched. Consequently, each frame assembly 10 may be personalized.

It should be noted that the frame assembly 10 of the instant invention may be used for mounting any picture, diploma, or important document. First, the document is measured and cut to conform to the dimensions of the recess 15 or photograph support area 16. The photograph support area 16 may include an adhesive or an adhering surface may be defined by the gasket for securing the document. The photograph support area 16 is defined on the backing plate 25 by the gasket 26, as previously discussed. If the support area 16 is provided with an adhesive, then a peel-off tape is removed therefrom for exposing the adhesive and placing the document or photograph thereon. Alternatively, the photograph may be placed in the recessed area 15 in proper alignment with the viewing area 12 instead of directly on the backing plate 25. In either event, before joining the backing plate to the frame plate 11, the gasket 26 must be securely affixed to the interior surface of the backing plate 25. The rear surface of the gasket 26 may include a peel-off tape for selectively exposing the adhesive. The peel-off tape is removed from the gasket 26, which is then pressed firmly against the backing plate 25, the outside dimensions of which should be in substantial conformity with the gasket 26 dimensions. Likewise, any peel-off tape must be removed from the opposing surface of the gasket 26 before attaching the backing plate 25 to the frame plate 11. Once the document or photograph 9 and gasket 26 are firmly in place, the outer edges of the backing plate 25 and the frame plate 11 are aligned and firmly pressed together under a uniform pressure. Sufficient force is required to completely seal off the border recessions and to assure firm contact with the sealing ribs 23, 24.

The sealing ribs 23, 24 provide two barriers which define sealed air chambers when the backing plate 25, gasket 26, and frame plate 11 are securely joined together to prevent any moisture, rain, or dirt from seeping into the recessed area 15. Thus, the primary seal is provided by sealing ribs 23 and 24 with the border recessions 22 therebetween to trap any moisture, dirt, or rain should they get by the outer sealing rib 23. To attach the frame assembly 10 to another surface, regardless of the type of surface, the double-sided adhesive pad 21 is affixed to the exterior surface of the backing plate 25. If the adhesive pad 21 has peel-off tape, then the peel-off tape must first be removed from the inner surface for affixing the pad 21 to the backing plate 25. Likewise, any peel-off tape must be removed from the exterior surface of the pad 21 before applying the frame assembly 10 to a selected surface. Once the peel-off tape is removed from the pad 21, it is firmly pressed against the object surface to which the frame assembly 10 is mounted. A variety of adhesives are available which can be utilized depending upon the supporting surface, such as wood, plastic, granite, cement, wallboard, or metal.

Use of the novel frame assembly 10 indoors eliminates the need for eyescrews, picture wire, and nail holders, as normally required with prior art units. Applicant has provided a simple, inexpensive, and convenient way of overcoming problems associated with conventional frame assemblies.

As pointed out earlier, the instant invention has many and varied uses. Although frame assembly 10 is shown as rectangular, it may comprise other shapes, such as oval, circular, triangular, etc. Further, the dimensions of the frame assembly 10 may be varied according to the purpose for which the frame assembly 10 is being used.

Different door designs, such as praying hands, crosses, Star of David, and others may be etched into the cover plate 30. This etching comprises an insert area which is created directly into the cover plate mold. Whether the cover plate employs the breakaway hinge 40, or the track and rail 50, the foregoing are designed and strategically positioned to detour windshear. The foregoing also provides easy on/off access and can easily be replaced in the case of vandalism or damage. In addition, the cover plate, together with the finished surface 13, provide a UV-resistance surface that prevents the penetration of any light into the area of the photograph or document mounted within the frame assembly 10. In addition, the cover plate 30 affords private viewing for family and friends of the deceased.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A weatherproof frame assembly for mounting and sealing a selected document, such as a photograph, therein, said frame assembly comprising:

a frame plate having a transparent viewing area for viewing the selected document when situated therebehind, said frame plate having a front surface and a rear surface which is planar;

a backing plate removably attached to said frame plate rear surface for enclosing the selected document between said transparent viewing area and said backing plate;

an opaque cover plate removably attached to said front surface of said frame plate in alignment with said transparent viewing area for concealing the selected document from light, said cover plate being impervious to light;

a cover plate attaching means for releasably attaching said cover plate to said frame plate so that said cover plate may be replaced without replacing the entire frame assembly; and a gasket, sandwiched between said backing plate and said frame plate rear surface, and a plurality of troughs formed in said rear surface, said gasket being in alignment with said troughs for sealing the selected document within said frame assembly and preventing the passage of moisture.

2. A frame assembly as recited in claim 1, further comprising:

a frame attaching means for attaching said frame assembly to a selected surface, said frame attaching means being fixed to a rear exterior surface of said backing plate.

3. A frame assembly as recited in claim 1, wherein said front surface of said frame plate is opaque for preventing the penetration of light into said frame assembly.

4. A frame assembly as recited in claim 1, wherein said gasket adheres to said backing plate on one surface and said frame plate rear surface on an opposite surface thereby joining said backing plate and said frame plate.

5. A frame assembly as recited in claim 1, wherein said frame plate further comprises:

a sealing rib on each side of each of said troughs, said sealing ribs and said troughs cooperating with said gasket to form a surface seal on each side of each of said troughs when said gasket is sandwiched between said frame plate rear surface and said backing plate.

6. A frame assembly as recited in claim 1, wherein said cover plate attaching means comprises:

a breakaway hinge means for joining said cover plate to said frame plate proximal a selected edge of said translucent viewing area such that said cover plate conceals said viewing area when said cover plate is closed thereover and breaks free from said frame plate under force without causing damage to said breakaway hinge means and said frame plate.

7. A frame assembly as recited in claim 1, wherein said cover plate attaching means comprises:

a track means, outlining opposing edges of said transparent viewing area, for slidably receiving said cover plate.

8. A frame assembly as recited in claim 1, wherein said front surface of said frame plate and said cover plate have complimentary beveled edges for mating said cover plate with said front surface over said transparent viewing area such that said front surface is substantially flush with said cover plate when said cover plate is mated to said frame plate.

9. A weatherproof frame assembly for mounting and sealing a selected document, such as a photograph, therein, said frame assembly comprising:

a frame plate having a transparent viewing area for viewing the selected document when situated therebehind, said frame plate having an opaque front surface and a rear surface;

a shallow recess formed in said rear surface for receiving and orienting the selected document in substantial alignment with said transparent viewing area;

a backing plate of substantially the same peripheral dimensions as said frame plate for enclosing the selected document between said transparent viewing area and said backing plate;

an opaque cover plate removably attached to said front surface of said frame plate in alignment with said transparent viewing area for concealing the selected document from light, said cover plate being impervious to light;

a breakaway hinge means for removably joining said cover plate to said frame plate proximal a selected edge of said transparent viewing area such that said cover plate conceals said viewing area when said cover plate is closed thereover and breaks free from said frame plate under force without causing damage to said frame plate or said cover plate;

a pliable gasket having an adhesive back surface for adhering to said backing plate and an adhesive front surface for adhering to said frame plate such that said backing plate and said frame plate are joined, said gasket sealing the selected document within said frame assembly between said backing plate and said frame plate so as to protect the selected document from moisture, including water, and joining said backing plate and said frame plate; and a trough formed in said rear surface with a sealing rib on each side of said trough, said sealing ribs and said trough cooperating with said gasket to form a surface seal on each side of said trough when said gasket is sandwiched between said frame plate and said backing plate.

10. A frame assembly as recited in claim 9, further comprising:

a frame attaching means for attaching said frame assembly to a selected surface, said frame attaching means being fixed to a rear exterior surface of said backing plate.

11. A frame assembly as recited in claim 9, further comprising an indicia means, displayed on at least one surface of said cover plate, for conveying a preselected message.

12. A frame assembly as recited in claim 9, wherein said front surface of said frame plate and said cover plate have complimentary beveled edges for mating said cover plate with said front surface over said transparent viewing area such that said front surface is substantially flush with said cover plate when said cover plate is mated to said frame plate.

13. A frame assembly as recited in claim 9, further comprising an indicia means, displayed on at least one surface of said cover plate, for conveying a preselected message.

14. A weatherproof frame assembly for mounting and sealing a selected document, such as a photograph, therein, said frame assembly comprising:

a unitary frontal frame having a transparent viewing portion, a rear surface and a recess centrally located in the rear surface of said frontal frame for receiving and orienting the selected document in viewing alignment with said viewing portion;

a backing plate for enclosing the selected document between said viewing portion and said backing plate when said backing plate is joined to the rear surface of said frontal frame;

an opaque cover plate removably attached to said frontal frame in alignment with said viewing portion for concealing the selected document from light, said cover plate being impervious to light;

a cover plate attaching means for releasably attaching said cover plate to said frontal frame so that said cover plate may be replaced without replacing the entire frame assembly;

an adhesive gasket simultaneously adherable to said backing plate and said frontal frame, said gasket joining said backing plate to said frontal frame; and a trough formed in said rear surface of said frontal frame with a sealing rib on each side of said trough, said sealing ribs and said trough cooperating with said gasket to form a surface seal on each side of said trough when said gasket is sandwiched between said frontal frame and said backing plate so as to protect the selected document from moisture, including water.

15. A frame assembly as recited in claim 14, wherein said frontal frame has a front surface with an opaque border surrounding said transparent viewing portion for drawing attention to said viewing portion and for assisting said cover plate in preventing the penetration of light into said frame assembly.

16. A frame assembly as recited in claim 15, wherein said front surface of said frontal frame and said cover plate have complimentary beveled edges for mating said cover plate with said front surface over said viewing portion such that said front surface is substantially flush with said cover plate when said cover plate is mated to said frontal frame.

17. A frame assembly as recited in claim 16, wherein said cover plate attaching means comprises:

a releasable hinge for joining said cover plate to said frontal frame proximal a selected edge of said transparent viewing portion such that said cover plate conceals said viewing portion when said cover plate is closed thereover.

18. A frame assembly as recited in claim 17, further comprising:

a frame attaching means for attaching said frame assembly to a selected surface, said frame attaching means being fixed to a rear exterior surface of said backing plate.

19. A frame assembly as recited in claim 16, wherein said cover plate attaching means comprises:

a track means, outlining opposing edges of said viewing portion, for slidably receiving said cover plate.

20. A frame assembly as recited in claim 19, further comprising:

a frame attaching means for attaching said frame assembly to a selected surface, said frame attaching means being fixed to a rear exterior surface of said backing plate.

* * * * *